United States Patent [19]

Reidt et al.

[11] Patent Number: 4,748,601

[45] Date of Patent: May 31, 1988

[54] GAME MONITORING DEVICE

[76] Inventors: Dean K. Reidt; Daryl R. Breitung, both of P.O. Box 33427, St. Paul, Minn. 55144-1000

[21] Appl. No.: 944,441

[22] Filed: Dec. 19, 1986

[51] Int. Cl.[4] ..... G04B 47/00

[52] U.S. Cl. ..... 368/10; 368/113; 368/1

[58] Field of Search ..... 368/10, 89, 107, 113, 368/3, 9

[56] References Cited

U.S. PATENT DOCUMENTS 4,615,624 10/1986 Goodrich ..... 368/1

*Primary Examiner*—Bernard Roskoski

*Attorney, Agent, or Firm*—David W. Anderson

[57] ABSTRACT

A game monitoring device includes a digital clock module which is controlled by a trip-thread which is pulled by the passage of game and results in the electrical contact of two leads which control the electronics of the digital clock module.

3 Claims, 1 Drawing Sheet

GAME MONITORING DEVICE

BACKGROUND OF THE INVENTION

1. Field of the Invention

The present invention relates to timing devices and, in particular, timing devices which may be actuated by the passage of big game, such as deer, and record the time of such passage.

2. Description of the Prior Art

Hunters of game, and particularly those hunters using limited-range weapons, need to know not only where the game travels but also its travel habits in regard to time. While game may be stalked with guns or rifles, the hunter using limited-range weapons such as a bow and arrow generally must wait for the game to present itself.

It is imperative that the hunter not only know where the game pass, but also at what time of the day they pass a particular position. Deer in particular are creatures of habit and tend to follow the same trail at approximately the same time everyday. Prior to the present invention, it was difficult to know when a deer passed a particular point. Since the hunter did not know the deer's starting point, knowledge of its path was of little value. If the deer started close to the hunter's position, he might pass early in the morning. Conversely, if he started very far from this position, the deer might not arrive until evening. In general, the deer hunter with the bow and arrow had to rely on guess work.

In addition, it is of great interest to naturalists to study the habits of animals. While devices have been developed for studying animals in captivity, there is need for devices to study the time-related habits of animals in the wild. There is particular need to provide devices which will not upset the natural habits of the game, but still allow detailed and accurate study of their time-related habits.

SUMMARY OF THE INVENTION

The game monitoring device of the present invention provides a non-intrusive method for determining the time of passage of game and includes a timing module similar to a digital clock module.

The timing module has a display to indicate visually the passage of time, a self-contained power supply for powering the timing module and two electrical leads extending from the timing module. The timing module is capable of continuous time-keeping and display when the leads are removed from electrical contact, discontinuing time-keeping when the leads are placed in electrical contact, retaining the time displayed when the leads were placed in contact while the leads remain in contact and re-commencing time-keeping when the leads are once more removed from electrical contact.

The two electrical leads preferably terminate in electrical contacts which are biased towards each other and these contacts are placed into or removed from contact by means of an insulating barrier which may be disposed between the contacts. To monitor game, the insulating barrier is inserted between the contacts and connected to a string or thread which is strung across a game path. Passage of an animal pulls the string or thread and removes the insulating barrier from between the contacts to permit contact between the two. This electrical contact stops time-keeping. Upon the arrival of the hunter, the insulating barrier is once more inserted between the contacts and the time of passage of the animal may be read from the timing module display.

The timing module is powered by the power source regardless of whether the leads are in contact to retain the time of contact between the contacts and thus the passage of the animal.

The timing module is preferably capable of additional functions such as date-keeping and day-keeping to increase the utility of the invention by providing information other than only the specific time of day.

BRIEF DESCRIPTION OF THE DRAWINGS

The present invention will be more thoroughly described with reference to the accompanying drawing, wherein like numbers refer to like parts in the several views, and wherein.

DESCRIPTION OF THE PREFERRED EMBODIMENT

Figure 1:
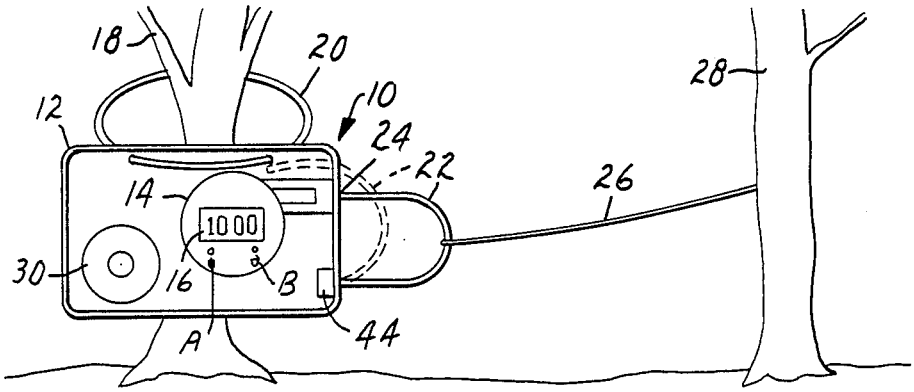
FIG. 1 is a top plan view of a game monitoring device according to the present invention, with the device positioned for use.
Figure 2:
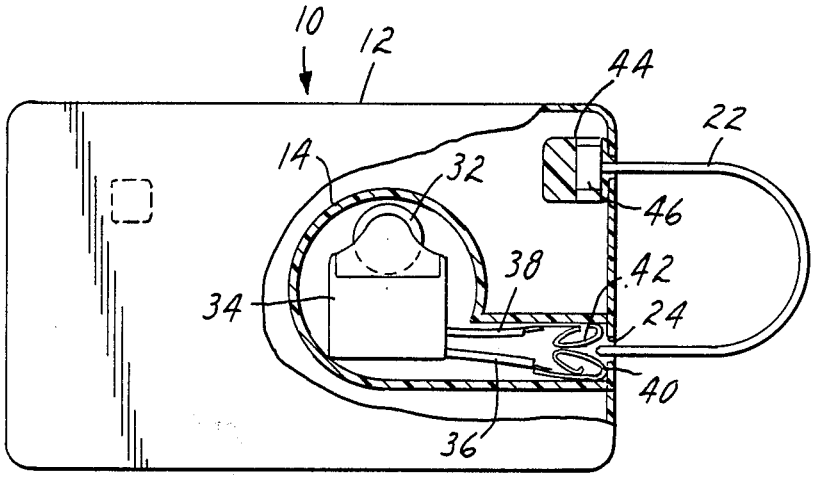
FIG. 2 is a bottom plan view, partially in section and rotated 180°, of the game monitoring device of FIG. 1.

FIGS. 1 and 2 illustrate the front and rear of a game monitoring device, generally indicated as 10, which includes a rectangular case 12 housing a digital clock module 14. The clock module 14 includes a digital display 16 and two actuating buttons "A" and "B". Buttons A and B may be pressed to display the various conventional digital clock displays available, such as time of day, date, day of week and seconds.

The game monitoring device 10 is utilized as shown in FIG. 1 by attaching the case 12 to a stationary object, such as a tree 18, by means of a tie cord 20, which may be any suitable flexible material such as plastic or organic fibers. The clock module 14 is actuated by inserting a trip strap 22 into a suitable opening 24 in the case 12. The means of actuation will be described in greater detail below. When the tracking device 10 is not in use, the trip strap 22 may be stored in the position shown in FIG. 1 by phantom lines by means of another opening in the case 24 (not shown).

To determine the time of passage of game, a thread 26, which may be polymeric or organic fiber, is tied to the trip strap 22, stretched across a potential game path and secured to a second stationary object 28, which is illustrated as being a second tree. A supply of the thread 26 is provided on a bobbin 30 located within the case 12.

FIG. 2 illustrates greater details of the clock module 14 and the means for actuating the clock module 14. The module 14 is powered by a battery 32 and includes a circuit board 34 which contains the clock module's electronics (not shown) and from which extends two leads 36 and 38 which terminate in spring-loaded contacts 40 and 42, respectively. The contacts 40 and 42 are formed of coiled metal in such a fashion that the contacts 40 and 42 will be biased toward each other and provide electrical contact between the two when an interfering object is not present.

The clock module 14 is readily obtainable as a standard item from digital watch module manufacturers and in particular may be obtained from Miura Corporation, San Francisco, Calif., and in 1985 had the serial number SG-372. The electronics of the clock module 14 operate in conjunction with the leads 36 and 38 extending therefrom in such a manner that time-keeping takes place in the normal fashion when the leads 36 and 38 are not in electrical contact and time-keeping is discontinued when the leads 36 and 38 are placed in electrical contact. It is also a function of the electronics of the clock module 14 that the time-keeping portion of the electronics of the clock module 14 retain the time when the leads 36 and 38 were placed in electrical contact, even though time-keeping has been discontinued and, therefore, the retained time does not advance.

Although reference is made to "time-keeping" the clock module 14, as mentioned above, also has the ability to display and retain other time related functions such as calendar date, day of the week and seconds. It is understood that "time-keeping" includes any or all of these functions.

The means for placing the leads 36 and 38 in electrical contact, and removing the leads 36 and 38 from electrical contact, are the electrical contacts 40 and 42 and the trip strap 22. The trip strap 22 is an insulating barrier in the form of an elongate strip which is attached at one end to a socket 44 in the case 12 by means of an enlarged head 46. The opposite end of the trip strap 22 may be inserted through the case opening 24 and forced between the contacts 40 and 42 to cause separation of the contacts 40 and 42 and thus prevent electrical contact therebetween.

In operation, the case 12 is first attached to the stationary object 18 and the trip strap 22 inserted between the contacts 40 and 42 to begin time-keeping. The present time of day, calendar date, day of the week and seconds are then entered in the clock module by means of the buttons A and B. The thread 26 is attached across the game path from the trip strap 22 and to the second stationary object 28. Upon the passage of game, the thread 26 is pulled which results in removal of the trip strap 22 from between the contacts 40 and 42. Since the contacts 40 and 42 are biased toward each other, removal of the trip strap 22 results in electrical contact between the contacts 40 and 42 and thus the leads 36 and 38 extending from the clock module 14.

This electrical contact results in discontinuation of advancement of time-keeping, although the electronics of the circuit board 34 remain powered by the battery 32 and retain the time to which the clock module 14 had advanced before the removal of the trip strap 22. These retained time functions will be maintained for a matter of months, if necessary, before the battery 32 expires.

To determine the time of removal of the trip strap 22, and thus the passage of the game, the hunter merely inserts the trip strap 22 again between the contacts 40 and 42 to re-commence time-keeping from the point of removal of the trip strap 22 and retention of the time functions. After reinsertion of the trip strap 22, the hunter is thus able to read the time of passage on the clock module display 16 and may view the other time related functions by manipulation of buttons A and B.

Although the present invention has been described with respect to only a single embodiment, it is recognized that many modifications will be apparent to those skilled in the art. For example, Miura Corporation, San Francisco, Calif. indicates that it would be easily possible to construct a clock module 14 having electronics which are controlled in a manner directly opposite to that described. In other words, time-keeping could be commenced when the contacts 40 and 42 are placed in contact rather than prevented from making electrical contact as described. The present invention is intended to include all such modifications which fall within the spirit and scope of the appended claims.

We claim:

1. A game monitoring device to determine the time of passage of an animal past a predetermined position, comprising:

a timing module having a display to indicate visually the passage of time, a self-contained power supply for powering said timing module and two electrical leads extending from said timing module, wherein said timing module is capable of continuous time-keeping and display when said leads are removed from electrical contact, discontinuing said time-keeping when said leads are placed in electrical contact, retaining the time displayed when said leads were placed in electrical contact during the period when said leads are in electrical contact and re-commencing said time-keeping when said leads are once more removed from electrical contact; and means for placing said leads in contact upon said passage of a said animal; and wherein said leads each terminate in an electrical contact biased toward each other and said means for placing said leads in contact is an insulation barrier disposed between said contacts and a string or wire connected to said barrier and adapted to be pulled upon passage of said animal and thereby remove said barrier from between said contacts and permit electrical connection of said contacts.

2. A game monitoring device according to claim 1 wherein said timing module is capable of continuous time-keeping and display when said leads are placed in contact, discontinuing said time-keeping when said leads are removed from contact, retaining the time displayed when said leads were removed from contact during the period when said leads are not in electrical contact and re-commencing time-keeping when said leads are once more placed in contact.

3. A game monitoring device according to claim 1 wherein said timing module is a digital clock module capable of calendar date-keeping and wherein date-keeping is discontinued, retained and re-commenced in conjunction with said time-keeping.

* * * * *